US008696091B2

(12) United States Patent
Gerner et al.

(10) Patent No.: US 8,696,091 B2
(45) Date of Patent: Apr. 15, 2014

(54) SCREEN PRINTED JET STACK HEATER

(75) Inventors: Bradley James Gerner, Penfield, NY (US); Peter J. Nystrom, Webster, NY (US); Andrew W. Hays, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 23 days.

(21) Appl. No.: 13/482,155

(22) Filed: May 29, 2012

(65) Prior Publication Data

US 2013/0321532 A1 Dec. 5, 2013

(51) Int. Cl.
*B41J 2/05* (2006.01)
*B41J 29/38* (2006.01)

(52) U.S. Cl.
USPC ..... 347/63; 347/17; 347/60

(58) Field of Classification Search
None
See application file for complete search history.

(56) References Cited

U.S. PATENT DOCUMENTS

2009/0277897 A1* 11/2009 Lashmore et al. ..... 219/544
2011/0024410 A1* 2/2011 Liu et al. ..... 219/546

* cited by examiner

*Primary Examiner* — Geoffrey Mruk
(74) *Attorney, Agent, or Firm* — MH2 Technology Law Group LLP

(57) ABSTRACT

Apparatus and methods for heating a printer jet stack. The apparatus includes a first layer and a second layer disposed generally parallel to the first layer. The apparatus also includes a heating layer including a thermal epoxy configured to generate heat when an electrical current is applied thereto. The heating layer is disposed between and bonds together the first layer and the second layer.

9 Claims, 4 Drawing Sheets

SCREEN PRINTED JET STACK HEATER

FIELD OF THE DISCLOSURE

The present disclosure relates generally to heaters for jet stacks that may be configured for use in inkjet printing machines.

BACKGROUND

Ink ejectors or "jet stacks" are typically found in inkjet printers and enable controlled deposition of ink on a medium (e.g., paper) upon which printing is desired. Jet stacks are typically provided by a series of brazed steel plates, which include one or more manifolds to route ink received from ink reservoirs to an array of jets from which ink is dispensed. Jet stacks may also include transducers (e.g., piezoelectric transducers) connected to a power circuit, such that the transducers are selectively excitable. When excited, the transducers deflect, which may motivate a volume of ink to proceed through the jets and onto the medium. In this way, the deposition of the ink may be electrically controlled via the selective excitation of the transducers.

Jet stacks are generally heated to an elevated temperature to avoid solidification of the ink during its traversal through the jet stack. To accomplish such heating, jet stacks may include a heater, generally disposed between two of its plates. The heater may be an etched metal foil layer, including one or more heater traces embedded in polyimide. The heater layer is then adhered on both sides to adjacent layers utilizing two separate layers of adhesive, typically provided by acrylic-based or epoxy-based thin films.

Such adhesive layers may add cost to the jet stack and may introduce efficiency limitations, since the heater is distanced from the adjacent plates, ink body chambers, and/or other structures by the adhesive layers. Furthermore, some adhesives, such as acrylic-based adhesives, are incompatible with certain inkjet applications, e.g., printing with UV inks.

What is needed then is an apparatus and method of efficiently heating a jet stack, while reducing the size and cost associated with such jet stack heating.

SUMMARY

An embodiment of the present disclosure is directed to an apparatus for heating a jet stack in a printer. The apparatus may include a first layer and a second layer disposed generally parallel to the first layer. The apparatus may also include a heating layer including a thermal epoxy configured to generate heat when an electrical current is applied thereto. The heating layer may also be disposed between and bonds together the first layer and the second layer.

Another embodiment of the disclosure is directed to a method for manufacturing a heater assembly for a printer jet stack. The method may include depositing a thermal epoxy on a first layer to form a heating layer, and bonding the first layer to a second layer using the thermal epoxy as an adhesive. The method may also include electrically coupling the thermal epoxy to a power circuit, such that, when the power circuit provides an electrical current to the thermal epoxy, the thermal epoxy heats at least the first layer.

A further embodiment of the disclosure is directed to a method for heating a printer jet stack. The method may include providing an electric current to a layer of thermal epoxy disposed between and bonding together a first layer and a second layer of the printer jet stack. The thermal epoxy generates heat using the electric current.

It is to be understood that both the foregoing general description and the following detailed description are exemplary and explanatory only and are not restrictive of the present teachings, as claimed.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings.

Figure 1:
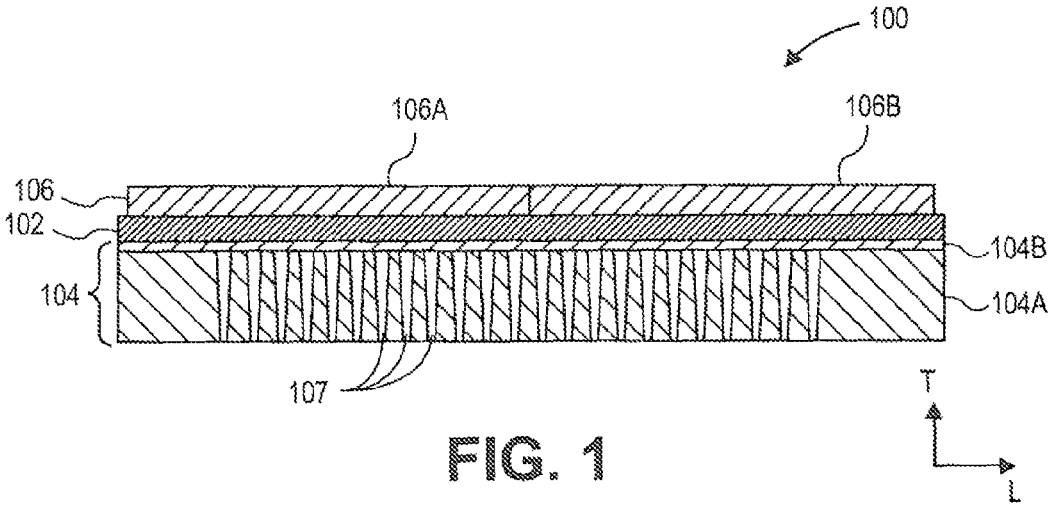
FIG. 1 illustrates a schematic side view of an exemplary heater assembly for a jet stack, according to an embodiment.

It should be noted that some details of the figure have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawing. In the drawings, like reference numerals have been used throughout to designate identical elements. In the following description, reference is made to the accompanying drawing that forms a part thereof, and in which is shown by way of illustration a specific exemplary embodiment in which the present teachings may be practiced. The following description is, therefore, merely exemplary.

FIG. 1 illustrates a side schematic view of a heater assembly 100 for a jet stack, which may be configured for use in an inkjet printer, according to an embodiment. The heater assembly 100 generally includes a heating layer 102, a first layer 104, and a second layer 106, which may be disposed in a generally parallel (i.e., parallel within acceptable tolerance) configuration. It will be appreciated that "generally parallel" is intended to encompass not only planar embodiments of the first and second layers 104, 106, but also congruent, non-planar configurations of any shape of the first and second layers 104, 106. The heating layer 102 may be disposed intermediate the first and second layers 104, 106 and may include a thermal epoxy that bonds the first and second layers 104, 106 together. The second layer 106 may be or include one or more flexible printed circuits ("flex prints") 106A, 106B, which may be disposed intermediate the heating layer 102 and one or more transducer arrays, e.g., piezoelectric transducers. The flex prints 106A, 106B may provide insulated electrical contacts for the transducer arrays, such that the transducers may be selectively controlled.

Electrical current may be applied to the thermal epoxy of the heating layer 102, thereby heating the heating layer 102 without, for example, requiring conductive traces, metal plates, or additional resistive heating elements in the heating layer 102. However, in some embodiments, traces, metallic plates, and/or other resistive heating elements may be used in addition to the thermal epoxy, without departing from the scope of the present disclosure. Additionally, the use of the epoxy of the heating layer 102 to bond together the first and second layers 104, 106 may obviate a need for additional adhesive layers. This may reduce the overall number of layers in the heater assembly 100 and may reduce costs, complexity of manufacture, and/or size and may increase efficiency.

In at least one embodiment, the epoxy of the heating layer 102 may be a carbon-filled epoxy, for example, CI-2026, commercially-available from Engineered Conductive Materials, LLC of Delaware, Ohio, USA. It will be appreciated that other resistive epoxies or other adhesive products, including products that are compatible for use with UV inks, and which are capable of adhering two layers together while also producing heat, are contemplated for use consistent with the present disclosure.

The first layer 104 may include a substrate 104A. The substrate 104A may be formed from stainless steel, another metal or metal alloy, or a non-metallic layer, such as a ceramic, polymer, elastomer, any combination thereof, or the like. The substrate 104A may be configured to receive thermal energy from the heating layer 102 and spread the heat energy over a horizontal cross section of the substrate 104A (e.g., in a lateral axis L). Accordingly, the substrate 104A may promote homogenous heat transfer across the surface area of the heater assembly 100.

The first layer 104 and/or the second layer 106 may be electrically isolated from the heating layer 102. For example, a dielectric adhesive may prevent electricity from conducting from the heating layer 102 to the first layer 104 and/or the second layer 106. In at least one specific embodiment, e.g., in the case of a stainless steel substrate 104A, the first layer 104 may include a dielectric layer 104B disposed intermediate the substrate 104A and the heating layer 102. The dielectric layer 104B may be formed from any suitable dielectric material, whether exhibiting adhesive properties or not, such as a thermoplastic polyimide, with a thickness and/or other properties tending to minimize the impact on heat transfer from the heating layer 102 to the substrate 104A. One example of such a material may be ELJ100, commercially-available from E.I. du Pont de Nemours and Company of Wilmington, Del., USA.

In an embodiment, the substrate 104A may be substantially thicker than the heating layer 102 and the dielectric layer 104B. For example, the substrate 104A may be between about 0.008 in. and about 0.010 in; however, in some embodiments, the substrate 104A thickness may be greater, for example, up to about 0.250 inches or more. The dielectric layer 104B may be between about 0.005 in. and about 0.001 in. thick. The heating layer 102 may be between about 0.0005 in and about 0.003 in., or between about 0.001 in. and about 0.002 in. It will be appreciated that such thicknesses are merely exemplary unless otherwise expressly stated herein.

As shown in FIG. 1, the substrate 104A may define a plurality of ink inlets 107 extending along a transverse axis T therethough. Although illustrated as generally straight in the transverse axis T, it will be appreciated that the ink inlets 107 may formed with one or more bends or turns as needed. The ink inlets 107 may be formed using any suitable process or device, for example, by milling, laser cutting, etching, or the like. Further, the ink inlets 107 may have a frustoconical shape, as shown, but in other embodiments, may be cylindrical or have any other suitable shape.

Figure 2:
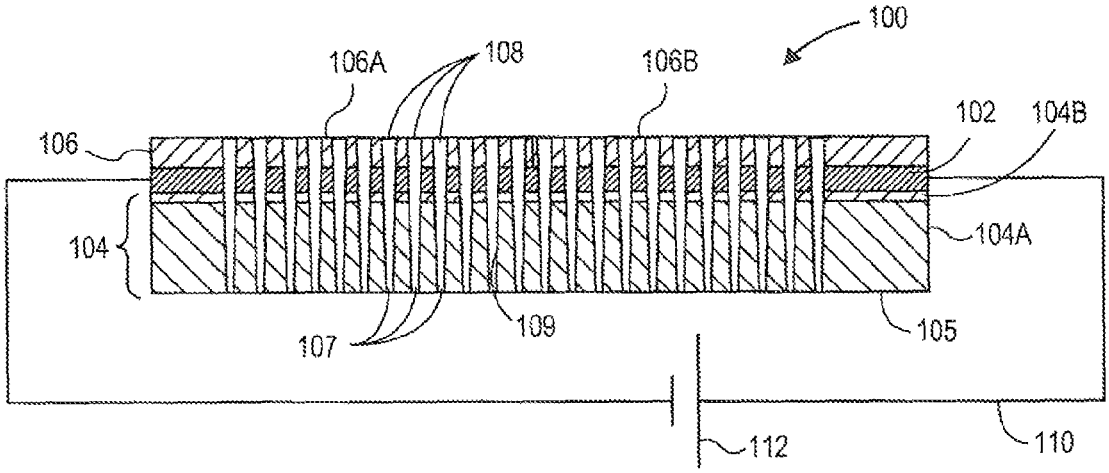
FIG. 2 illustrates a schematic side view of the heater assembly embodiment shown in FIG. 1, with ink inlets extending therethrough, according to an embodiment.

With continuing reference to FIG. 1, FIG. 2 illustrates a side schematic view of the heater assembly 100 after a laser-cutting process or another type of cutting or material removal operation, according to an embodiment. Such operation may form ink inlets 108 extending along the transverse axis T through the heating layer 102, the second layer 106, and, when included, through the dielectric layer 104B. Further, the ink inlets 108 may be aligned with the ink inlets 107, such that the ink inlets 107 and 108 form a single, continuous ink inlet 107, 108 extending transversely through the heater assembly 100. As such, the combined ink inlets 107, 108 may each provide an ink conduit through the heater assembly 100. It will be appreciated that the ink inlets 107, 108 are not necessarily formed during separate operations and may be formed from a single cutting or material removal operation.

In some embodiments, the portions of the first layer 104, the heating layer 102, and/or the second layer 106 defining the ink inlets 107, 108 may be coated with a dielectric coating 109. The dielectric coating 109 may be applied using any suitable process, for example, by spraying the coating into the ink inlets 107, 108 using a sprayer, as will be described in greater detail below. The dielectric coating 109 may prevent electrical current passing from the heating layer 102 to ink traversing the heater assembly 100 via the ink inlets 107, 108. In some embodiments, areas of the substrate 104A, heating layer 102, and/or second layer 106 proximal to, but offset from, the ink inlets 107, 108 may also or instead include dielectric material, so as to form a dielectric barrier around the ink inlets 107, 108, to protect the ink in the ink inlets 107, 108 from electrical contact.

With continuing reference to FIG. 2, in exemplary operation, an electric current may be supplied to the heating layer 102 of the heater assembly 100. For example, the heating layer 102 may form part of an electrical power circuit 110 with a power supply 112. Those skilled in the art will readily appreciate that the power supply 112 may be a battery or part of another AC or DC power circuit drawing power from, for example, a municipal power grid. The epoxy of the heating layer 102 may convert the electrical energy applied thereto by the power supply 112 into thermal energy. Thus, the heater assembly 100 may serve to keep the jet stack, including the manifold, piezoelectric array, and/or other components, heated to an operational temperature, thereby avoiding solidification of the ink. The operational temperature may be, for example, between about 90° C. and about 150° C., about 100° C. and about 125° C., or about 110° C. and about 120° C.

Figure 3:
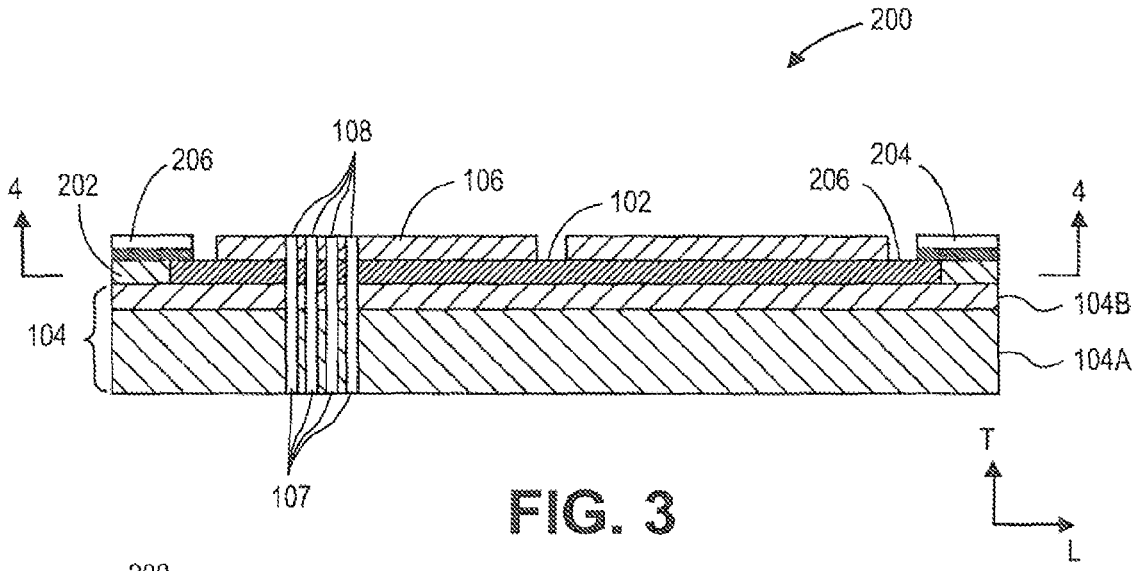
FIG. 3 illustrates a side schematic view of another exemplary heater assembly, according to an embodiment.
Figure 4:
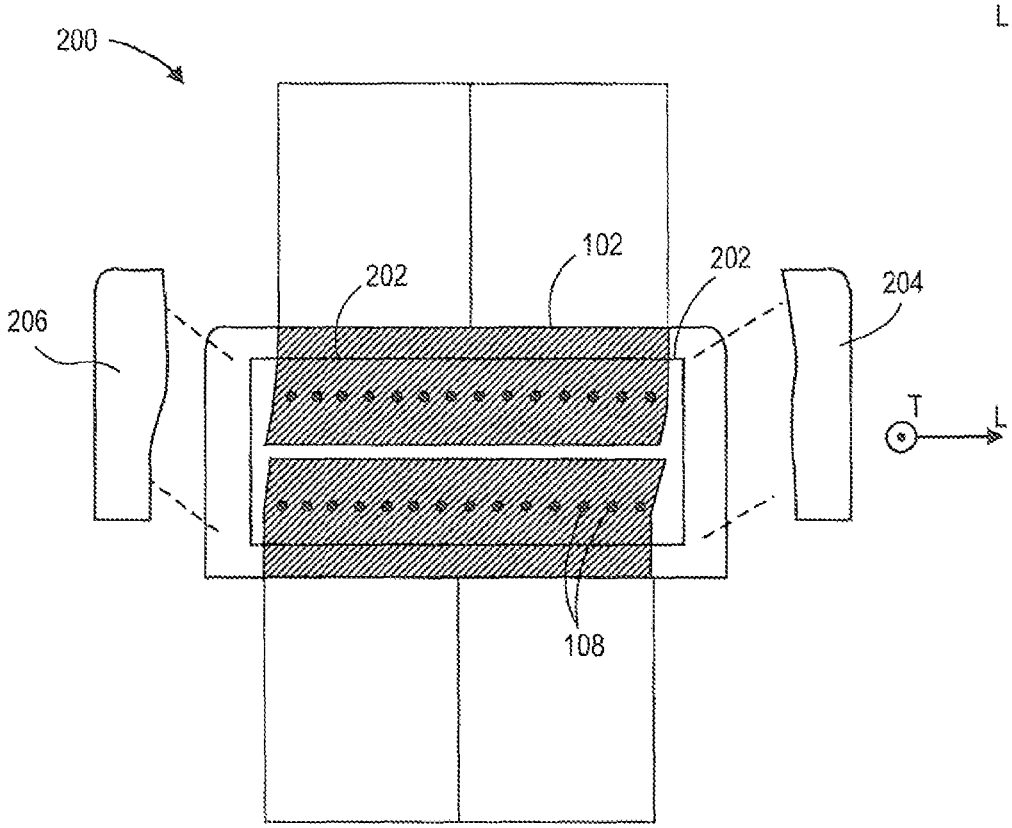
FIG. 4 illustrates an exploded plan view of the heater assembly embodiment of FIG. 3, taken along line 4-4, according to an embodiment.

FIG. 3 illustrates a side schematic view of another exemplary heater assembly 200, according to an embodiment. FIG. 4 illustrates an exploded perspective view, taken alone line 4-4 of FIG. 3, of the heater assembly 200, according to an embodiment. The heater assembly 200 depicted in FIGS. 3 and 4 may be similar to the heater assembly 100 and, therefore, like elements are indicated with like numerals.

With reference to both FIGS. 3 and 4, the heater assembly 200 may additionally include a window frame 202 and first and second flex circuit spacers 204, 206. The flex circuit spacers 204, 206 may be provided for planarity and potential electrical stimulus. The window frame 202 may be disposed proximal the perimeter of the heating layer 102 and may be offset from the edges thereof, so as to form a border or barrier around at least a portion of the heating layer 102. The window frame 202 may be formed from a dielectric material, such as ELJ100 polyimide, another type of polyimide, or any other suitable material, such that the window frame 202 electrically isolates the heating layer 102 from structures and/or areas adjacent the heater assembly 200. In at least one embodiment, the window frame 202 may be about 0.001 in. thick (i.e., in the transverse axis T).

The flex spacers 204, 206 may each span one of the sides of the first layer 104 and may extend inward to overlap the window frame 202 and electrically couple with, for example, make contact with, the epoxy of the heating layer 102. As such, the flex spacers 204, 206 may each provide a bus bar electroplated on a single side, for example, providing electrical contact with a large cross-section of the epoxy and thereby promoting uniform heat transfer. The window frame 202 may be positioned at least partially intermediate the substrate 104A and the flex spacers 204, 206. For example, in embodiments including the dielectric layer 104B, the window frame 202 may be positioned at least partially intermediate the flex spacers 204, 206 and the dielectric layer 104B and/or intermediate the flex spaces 204, 206 and the substrate 104A.

Further, the flex spacers 204, 206 may include a metal layer or tape adhered or otherwise coupled thereto, such that flex spacers 204, 206 form an electrical contact with the heating layer 102. The flex spacers 204, 206 may also include conductive leads, such that the flex spacers 204, 206 are configured to electrically connect to the power supply 112 (FIG. 2) to the epoxy of the heating layer 102. Accordingly, power may be supplied from the power supply 112 to the heating layer 102, and thus the epoxy thereof, via the flex spacers 204, 206.

Figure 5:
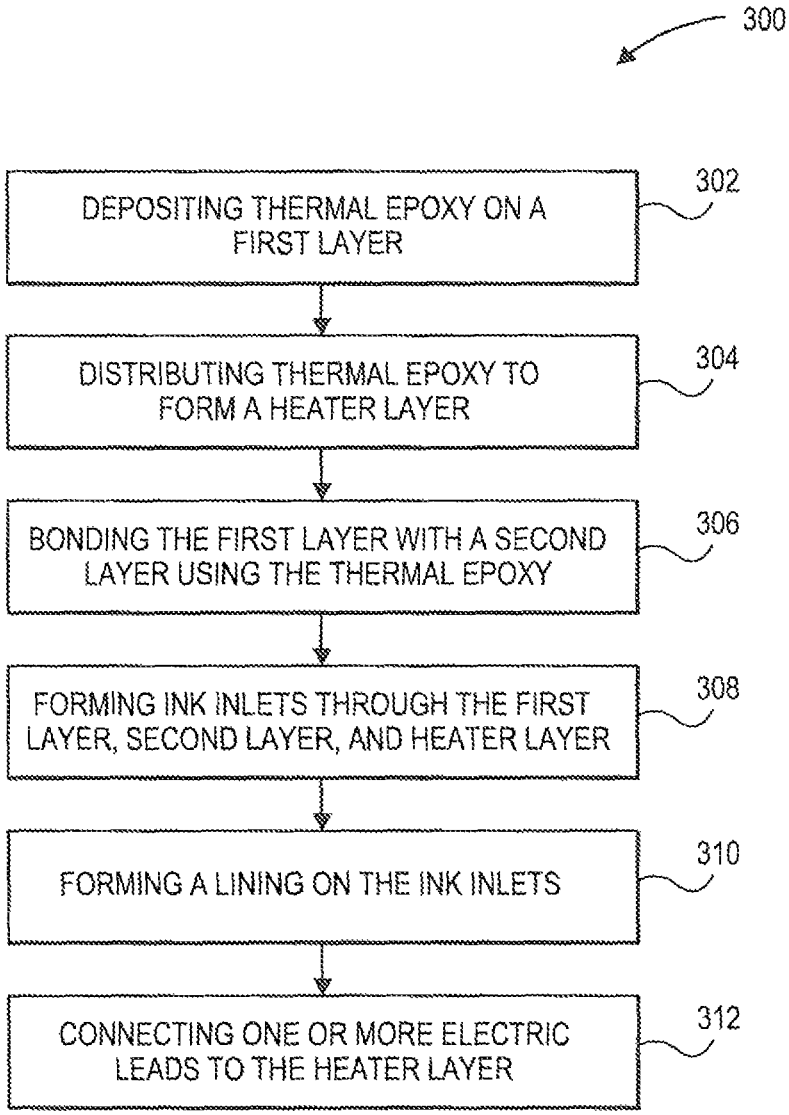
FIG. 5 illustrates a flowchart of an exemplary method for manufacturing a heater assembly for a printer jet stack, according to an embodiment.

FIG. 5 illustrates a flowchart of a method 300 for manufacturing a heater assembly for a jet stack, according to an embodiment. The method 300 may include manufacturing one or more embodiments of the heater assembly 100 and/or the heater assembly 200 and may thus be best understood with reference thereto; accordingly, additional reference is made to the embodiments illustrated in FIGS. 1-4.

The method 300 may include depositing a thermal epoxy on a first layer 104 to at least partially form the heating layer 102, as at 302. The first layer 104 may or may not be electrically isolated from the heating layer 102. The method 300 may also include distributing the thermal epoxy on the first layer 104, as at 304. For example, the thermal epoxy may be spread on the first layer 104 using a draw bar or squeegee, so as to result in a substantially uniform (i.e., uniform within a reasonable tolerance) thickness for the heating layer 102. This combination of depositing and distributing/spreading may be referred to as "screen printing." Further, such uniformity of thickness may promote uniform heat transfer from the heating layer 102 to the substrate 104A during operation of the heater assembly 100 or 200. The method 300 may also include bonding the first layer 104 to the second layer 106 with the thermal epoxy of the heating layer 102, as at 306. The second layer 106 may or may not be electrically isolated from the heating layer 102.

The method 300 may then proceed to forming ink inlets 108 at least through the second layer 106, the heating layer 102, and, when included, the dielectric layer 104B of the first layer 104, as at 308. The substrate 104A may be provided with ink inlets 107 already formed therein, prior to assembly of the heating layer 102 and/or the second layer 106. Accordingly, the ink inlets 107, 108 may thus be aligned to form a continuous ink conduit through the heater assembly 100 or 200. In other embodiments, the ink inlets 107, 108 may be formed at 308 as part of a single or compound operation. In one embodiment, forming the ink inlets 108 and/or 107 may proceed by one or more laser cutting processes.

The method 300 may then proceed to forming a lining or coating the portions of the second layer 106, the heating layer 102, and/or the first layer 104 that define the ink inlets 107, 108, as at 310, for example, to provide the dielectric coating 109. The coating 109 may prevent electrical current from passing to ink flowing through the ink inlets 107, 108. The coating 109 may be applied by placing a sacrificial layer of, for example, removable tape on the bottom 105 of the first layer 104 or on top of the flex prints 106, or both. The tape may be punctured or otherwise formed with holes, cut-outs, etc., to reveal the ink inlets 107, 108. The coating 109 may then be applied, for example, sprayed, onto the surface to which the tape is disposed, such that the coating 109 is received through the holes in the tape and into the ink inlets 107, 108. The coating 109 may then form on the tape and on the portions of the first and second layers 104, 106, and the heating layer 102 defining the ink inlets 107, 108. The tape may then be removed to reveal the un-coated surface, with any residual adhesive transferred from the tape to the surface being removed.

Before, during, or after any of the above portions of the method 300, the method 300 may include connecting one or more electrical leads to the heating layer 102, as at 312. For example, one or more bus bars may be connected directly to the epoxy of the heating layer 102 in any suitable manner. For example, the bus bars may be provided by the flex spacers 204, 206, and may be secured in place using fasteners, the epoxy of the heating layer 102, or by using another process or structure, such as adhesion using a second adhesive, combinations thereof, or the like. The flex spacers 204, 206 may provide an electrical connection with the power circuit 110. Accordingly, the flex spacers 204, 206 may each serve to connect the epoxy of the heating layer 102 to the power supply 112 of the power circuit 110.

In some embodiments, the method 300 may also include bonding a window frame 202 to the substrate 104A, for example, proximal edges of the substrate 104A. The window frame 202 may be constructed of a dielectric material, for example, polyimide or a ceramic, polymer, elastomer, or the like. The bonding at 304 may proceed by adhering the window frame 202 to the first layer 104 using any suitable adhesive.

In various embodiments, the flex prints 106A, 106B may be bumped flexible printed circuits and may be pressed in a thermal press. Accordingly, for example, to avoid squeezing the epoxy of the heating layer 102 from between the substrate 104A and the flex prints 106A, 106B, the flex prints 106A, 106B, may be pre-mounted to the back of the transducer array. Another exemplary embodiment may include using a patterned bumped piezo-plating or silver epoxy.

Figure 6:
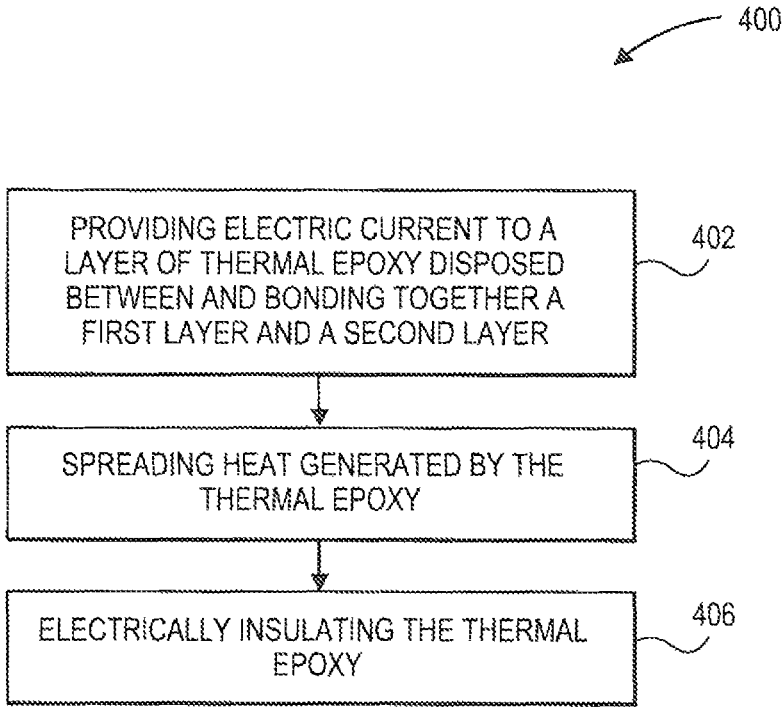
FIG. 6 illustrates a flowchart of an exemplary method for heating a printer jet stack, according to an embodiment.

FIG. 6 illustrates a flowchart of a method 400 for heating a printer jet stack, according to an embodiment. The method 400 may proceed by operation of one or more embodiments of the heater assembly 100 and/or 200 and thus may be best understood with reference thereto; accordingly, reference is additionally made to the embodiments illustrated in FIGS. 1-4.

The method 400 may include providing an electric current to a heating layer 102 of thermal epoxy disposed between and bonding together the first layer 104 and the second layer 106 of the printer jet stack, as at 402. The thermal epoxy may generate heat using the electrical current, i.e., by transferring the electric energy provided by the electric current to heat energy. The method 400 may also include spreading heat emitted by the thermal epoxy of the heating layer 102 using the substrate 104A of the first layer 104, as at 404. Further, the method 400 may include electrically insulating the epoxy from surrounding structures, as at 406, to avoid shorting the power circuit 110 and/or damaging other elements of the jet stack. For example, the method 400 may include coating ink inlets 107, 108 formed in the heater assembly 100 and/or 200 with the dielectric coating 109. The method 400 may also include electrically insulating the substrate 104A from the heating layer 102 using the dielectric layer 104B. Additionally, the window frame 202 may be provided to laterally insulate the epoxy.

Referring now generally to the embodiments disclosed herein, it will be appreciated that providing a heating layer 102 having an epoxy that may enable warming the jet stack by conversion of electrical power to heat, while also providing a bonding agent to adhere the flex prints 106 to the substrate 104A, may provide an improved heater assembly for a jet stack. In an embodiment, the heater assemblies 100 or 200 may obviate a need for an etched metal heater plate or foil, and/or may obviate a need for one or more layers of adhesive between the heater plate or foil and adjacent components. This may, for example, provide compatibility for use of the heat assemblies 100 and/or 200 in situations where some adhesive layers may preclude use, such as, for example, in UV inks.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An apparatus for heating a jet stack in a printer, comprising:

a first layer;

a second layer disposed generally parallel to the first layer; and a heating layer comprising a thermal epoxy configured to generate heat when an electrical current is applied thereto, wherein:

the heating layer is disposed between and bonds together the first layer and the second layer; and the first layer, the second layer, and the heating layer collectively define a plurality of ink inlets extending therethrough, each of the plurality of ink inlets being configured to provide an ink conduit through the first layer, the second layer, and the heating layer.

2. The apparatus of claim 1, further comprising a dielectric adhesive configured to electrically isolate at least one of the first layer and the second layer from the heating layer.

3. The apparatus of claim 1, wherein the first layer comprises a substrate configured to spread heat generated by the heating layer.

4. The apparatus of claim 3, wherein the first layer further comprises a dielectric layer configured to electrically insulate the substrate from the thermal epoxy.

5. The apparatus of claim 1, wherein the second layer comprises one or more flexible printed circuit configured to be electrically coupled to an array of transducers.

6. The apparatus of claim 1, wherein the heating layer is free from conductive traces and other heating elements, apart from the thermal epoxy.

7. The apparatus of claim 1, wherein the plurality of ink inlets are at least partially coated with a dielectric coating.

8. The apparatus of claim 1, further comprising two or more bus bars electrically coupled with the thermal epoxy of the heating layer.

9. The apparatus of claim 1, further comprising a window frame disposed proximal a perimeter of the heating layer, the window frame being configured to electrically isolate a portion of the heating layer.

* * * * *